United States Patent [19]

Plath et al.

[11] Patent Number: 4,535,608

[45] Date of Patent: Aug. 20, 1985

[54] CIRCULAR KNITTING MACHINE FOR PRODUCING ONE-FACE PLUSH WEBS

[75] Inventors: Ernst-Dieter Plath, Albstadt; Dieter Klinger, Oberndorf, both of Fed. Rep. of Germany

[73] Assignee: Sipra Patententwicklungs-und Beteiligungsgesellschaft mbH, Stuttgart, Fed. Rep. of Germany

[21] Appl. No.: 572,923

[22] Filed: Jan. 20, 1984

Related U.S. Application Data

[63] Continuation-in-part of Ser. No. 303,712, Sep. 18, 1981, abandoned.

[30] Foreign Application Priority Data

Sep. 20, 1980 [DE] Fed. Rep. of Germany ..... 3035582

[51] Int. Cl.[3] ..... D04B 9/12; D04B 15/24

[52] U.S. Cl. ..... 66/9 R; 66/93; 66/108 R

[58] Field of Search ..... 66/9 R, 12, 92, 93, 66/107, 108 R

[56] References Cited

U.S. PATENT DOCUMENTS

| | | | |
|---|---|---|---|
| 1,534,785 | 4/1925 | Houseman | 66/107 |
| 1,790,832 | 2/1931 | O'Lena | 66/93 |
| 1,977,590 | 10/1934 | Page et al. | 66/108 R |
| 2,925,724 | 2/1960 | Coile | 66/107 |
| 2,966,782 | 1/1961 | Deiss et al. | 66/9 R |
| 3,703,819 | 11/1972 | Townsend et al. | 66/93 |
| 4,020,653 | 5/1977 | Mishcon et al. | 66/93 |
| 4,103,518 | 8/1978 | Lombardi et al. | 66/107 |

FOREIGN PATENT DOCUMENTS

| | | | |
|---|---|---|---|
| 2038376 | 7/1980 | United Kingdom | 66/92 |

*Primary Examiner*—Wm. Carter Reynolds
*Attorney, Agent, or Firm*—Michael J. Striker

[57] ABSTRACT

A circular knitting machine for producing one-face plush webs of main threads and plush threads has a plurality of needles, a plate ring provided with plate members, and a plurality of cam members for controlling the longitudinal movement of the needles and the transverse movement of the plate members, wherein the needles and the plate members are arranged so that each of the needles cooperates with two parallel and separately controlled plate members movable relative to one another, of which one of the plate members has a slot for receiving a main thread and a stepped back for supporting a plush thread, and the other of the plate members has a thread placing edge limiting the effective length of the slot of the one plate member. The cam members are arranged so that the relative movement between the plate members results in tightening of a plush loop when the associated needle is raised, in placing the main and plush threads in positions when the needle is in a loop sinking position, and in tightening a mesh produced from the plush and main threads when the needle is in the loop sinking position and prepared for being raised.

7 Claims, 13 Drawing Figures

VI
VII
VIII
XI
XII
XIII
N

CIRCULAR KNITTING MACHINE FOR PRODUCING ONE-FACE PLUSH WEBS

CROSS-REFERENCE TO A RELATED APPLICATION

This applications is a continuation-in-part of application Ser. No. 303,712 filed Sept. 18, 1981, now abandoned.

BACKGROUND OF THE INVENTION

The present invention relates to a circular knitting machine for producing a one-face plush web from main threads and plush threads.

Circular knitting machines of this general type are known in the art. A known machine includes a needle cylinder provided with latch-type needles, a plate ring provided with plate members, and cam members associated therewith for controlling the longitudinal movement of the needles and plate members. One such circular knitting machine is described for example in the German Pat. No. 625,142 and in the publication "Wirkerei und Strickerei-Technik" 1978, pages 4–13. In the known plush plate members, the length of the slot for receiving the main threads is fixed. Moreover, this slot is very wide in its initial region, which requires a respectively longer adjustment path of the needles cooperating with the plate members and maintains thereby the peripheral length of the system of a machine relatively great. In the known plush plate members a tensioning of the plush loops takes place with the aid of the step of the back portion; however, this tensioning movement is always dependent on the thickness and type of the plush threads used. An adjustment of the tensioning thickness for influencing the plush pattern is not possible in the known circular knitting machines.

A further plush machine is known, in which two separately controllable plate members are utilized, wherein in the case of two plate members a cutting plate member for ripping up of the plush loops is used. Such construction is disclosed, for example, in the German Pat. No. 1,585,051.

SUMMARY OF THE INVENTION

Accordingly, it is an object of the present invention to provide a circular knitting machine which avoids the disadvantages of the prior art.

These and other objects of the invention are attained by a circular knitting machine for producing one-face plush webs from main threads and plush threads, the machine comprising a plurality of movable needles; a plate ring including a plurality of plate members cooperating with said needles for producing a mesh from said threads; and a plurality of cam members for controlling a longitudinal movement of said needles and for controlling a movement said plate members radially towards and away of said needles, said needles and said plate members being arranged so that each of said needles cooperates with two adjacently positioned, parallel plate members to produce and tighten plush loops to form a mesh, one of said two plate members having a slot for receiving a main thread and a stepped back portion for supporting a plush thread, whereas the other of said two plate members has a thread placing edge adapted to limit the effective length of said slot of said one plate member, said cam members being adapted to control said two plate members separately and independently from each other and being arranged so that a relative movement between said two plate members results (a) for tightening a plush loop when the associated needle is in a raised position, (b) for positioning main and plush threads when the needle is moved to a loop sinking position, and (c) for tightening a mesh produced from plush and main threads when the needle is in the loop sinking position and is beginning to be raised.

By subdividing a conventional plush plate member into two relatively movable and independently controlled individual plate members, an accurate influence of the mesh and loops of the plush web is attained, particularly when both inventive individual plate members are influenced by adjustable cam members. In accordance with another advantageous feature of the present invention, a cam member which acts upon the first plate member for providing plush loop post tightening, and a cam member acting upon the second plate member for providing thread placing are adjustable in the direction of displacement of the plate members. These cam members can be adjusted in dependence upon the type and thickness of the plush threads used and the main threads used.

By the subdivision of a conventional plush plate member into two separately controllable individual plate members it is also possible to maintain the receiving slot for the main threads in the first plate member very small, whereby its width is determined only by the predetermined maximum yarn thickness. Correspondingly, the displacement stroke of the plate members and the associated needles is shorter than in the known plush machine.

Because of the small receiving slot, the plush loop is taken completely tight during the initial position in the material by the back of the plate member, so that it can be repeatedly tightened. Because of the small slot, the plush loop taking is guaranteed and a very short plush loop can be formed.

The subdivision into two individual plate members provides also for the advantage that an easily polished thread placing edge is obtained, which essentially contributes to fine treatment of the threads and thereby to obtaining a neat knitting pattern.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE PREFERRED EMBODIMENTS

Figure 1:
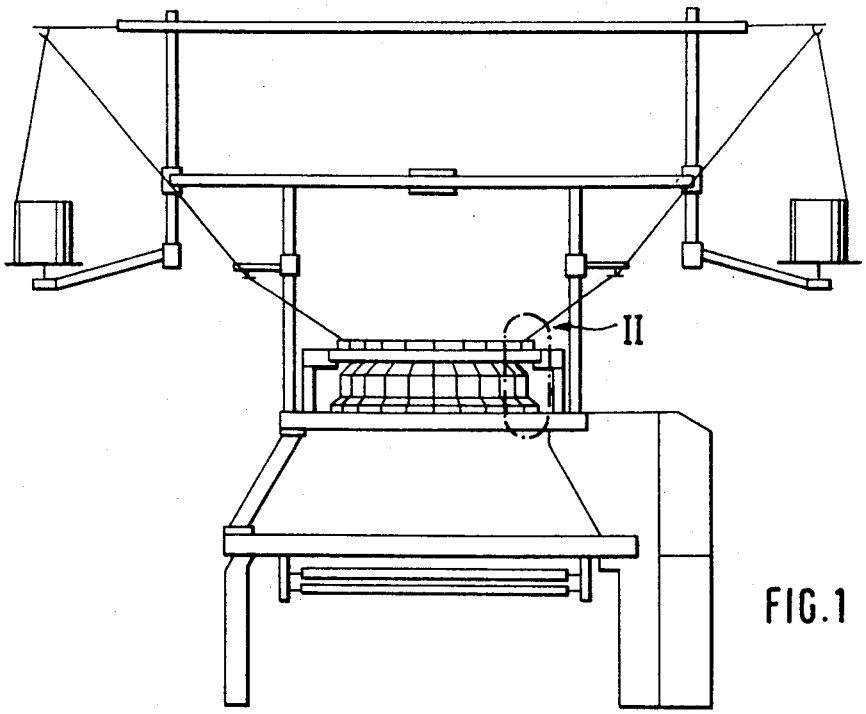
FIG. 1 is a schematic front view of the knitting machine of the invention.
Figure 2:
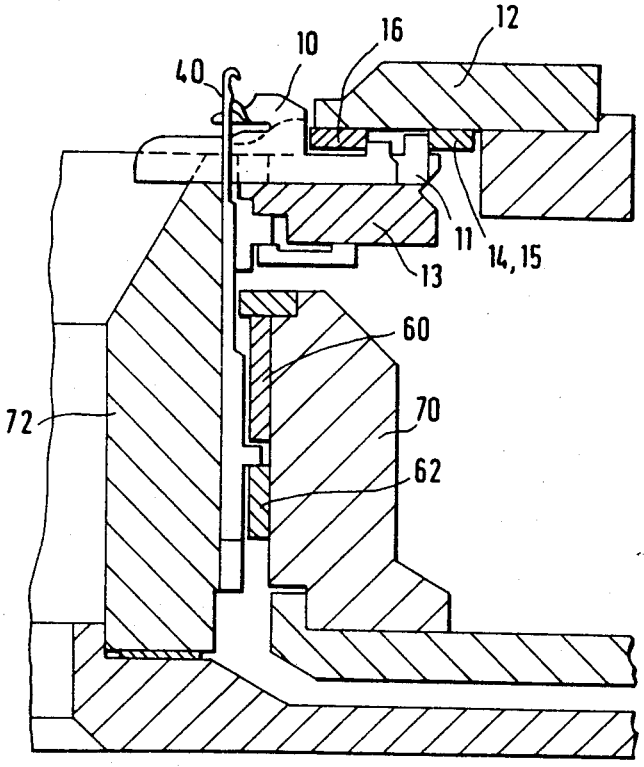
FIG. 2 is a partial sectional view of the part of the machine denoted by arrow II in FIG. 1.

Referring now to the drawings, and first to FIGS. 1 and 2, reference numeral 12 designates one segment or section of a cam ring formed, as commonly known, of a plurality of cam sections 12 adjacent to each other. The cam ring is located concentrically outside of a needle cylinder 72 in which needles 40 are arranged in the known fashion. Reference numeral 13 denotes a plate ring also partially shown in FIG. 10, in which a first plate or a plush sinker plate 10 and a second sinker plate or a knockover plate 11 are supported.

Figure 10:
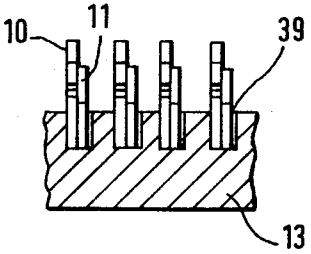
FIG. 10 is a partial sectional view of the plate ring with the sinker plates inserted therein.

FIG. 10 shows a partial section through the plate ring 13, in the slots 39 of which plates 10 and 11 are pairwise positioned.

Reference characters 60 and 62 in FIG. 2 designate cam elements for the needles. Cam elements 60 and 62 are supported on a cylindrical cam sleeve 70.

Cam members 14, 15 and 16 for sinker plates 10 and 11 are rigidly secured on the cam ring section 12.

Figures 3, 4, 5:
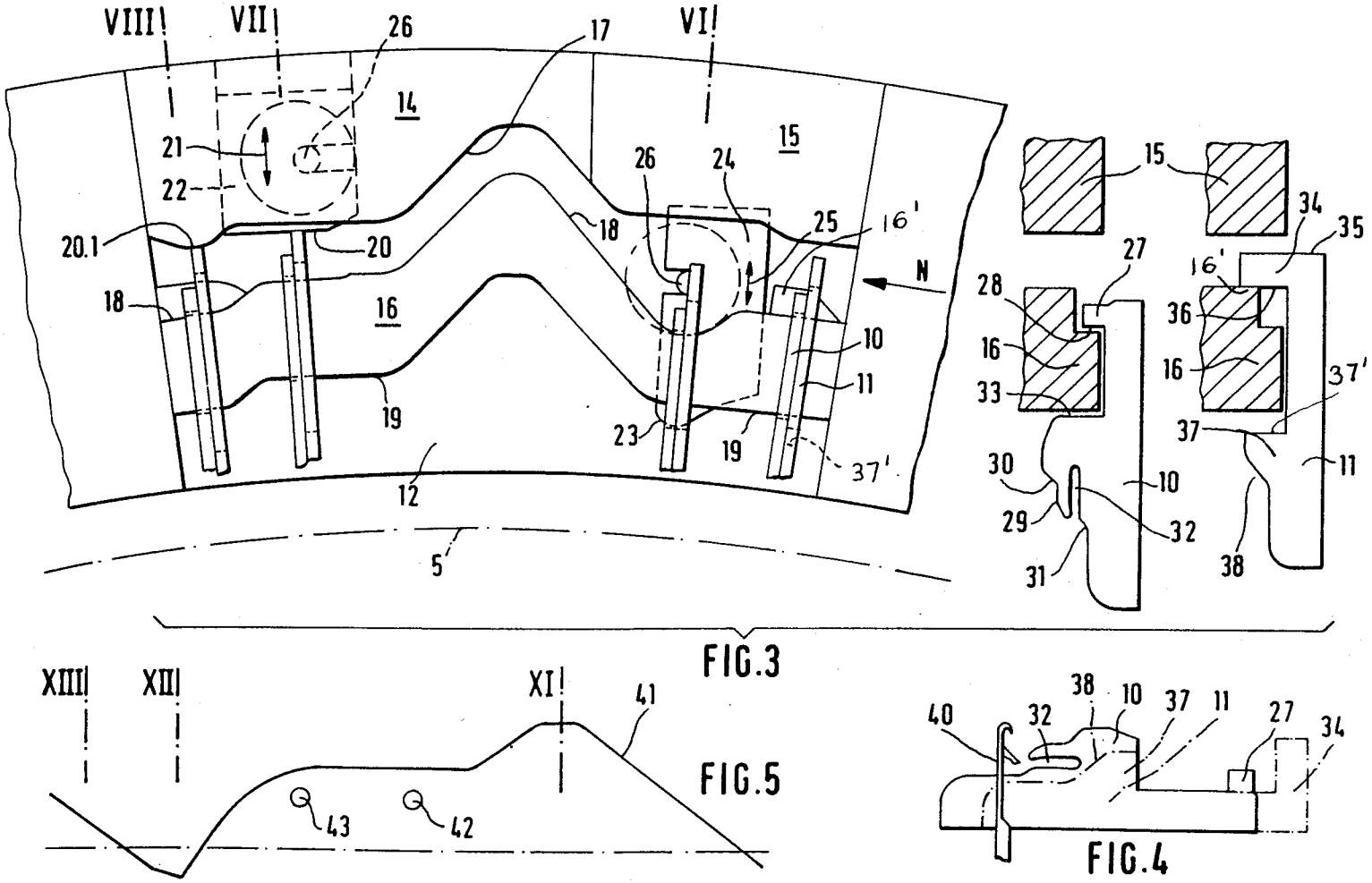
FIG. 3 is a schematic plan view of cam members which serve for controlling both sinker plates of the system, together with individual lateral views of both sinker plates.
FIG. 4 is a lateral view of the two sinker plates in the overlapping position, together with a latch-type needle.
FIG. 5 is a view showing a control curve of the knitting needle and indication of the thread feed positions.

With reference to FIG. 3 it should be noted that reference character 5 identifies an outer contour of the needle cylinder 72.

The cam members 14 and 15 can be formed of one piece with one another as an integral member. Both cam members 14 and 15 form together a guiding edge 17. The fixed cam member 16 forms at its one side a guiding edge 18 and at its other side a guiding edge 19. A portion of guiding edge 17 is formed by a front edge 20 of a cam member 22 which is arranged behind the fixed cam member 14 and is adjustably movable in the direction of double arrow 21.

Figure 6:
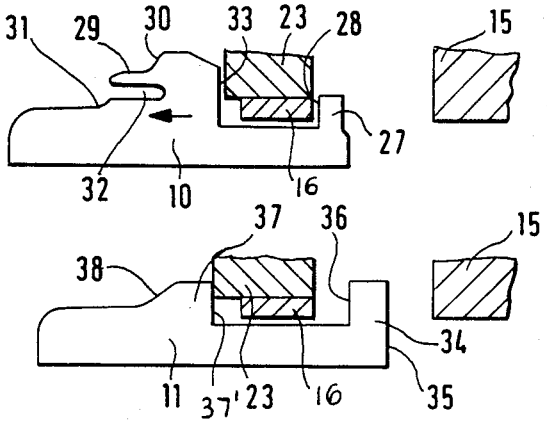
FIGS. 6 through 8 illustrate lateral views, partially in sections, of the cooperating sinker plates in the positions corresponding to lines VI, VII, and VIII, respectively, in FIG. 3.
Figure 7:
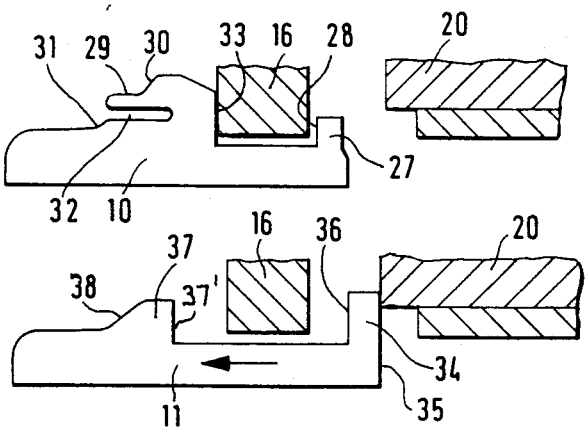
Figure 8:
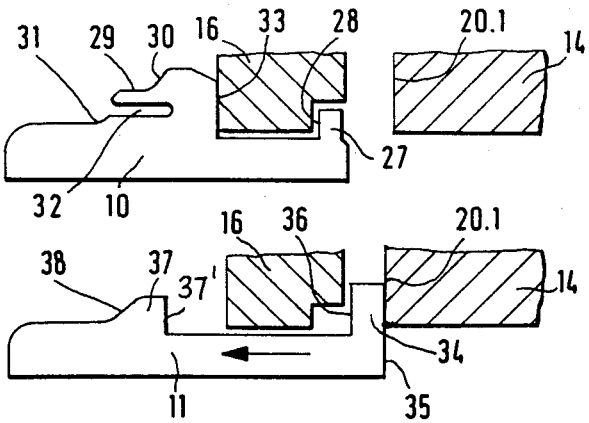

An end portion 20.1 of the guiding edge 17 extends inwardly towards the plates 10, 11. The cooperation between the guiding edge 17 and plate 11 is shown in FIGS. 6 through 8. The guiding edge 19 of the fixed cam member 16 is overlapped by a front edge 23 of a cam member 24 located above the cam member 16 and is adjustable in the adjusting direction identified by double arrow 25. The adjustment or displacement of both cam members 22 and 24 is performed by known adjustment eccentrics 26.

The sinker plate 10 has at its rear end a control leg 27 with a returning edge 28 cooperating with the guiding edge 18 of cam member 16. The plate sinker 10 has in its central part a back portion 29 provided with a step 30. A slot 32 with a flat lifting bevel surface 31 in front of the slot opening is provided below the back portion 29. The back portion terminates in a driving-out edge 33 cooperating with the guiding edge 19 of the cam member 16.

The function of the end portion 20.1 of the cam 14 is to displace plate 11 to its outermost position so as to hold the loops, formed by the needles, tightened.

The cam member 16 has a portion 16′, the function of which is to move the plate 11, which has been earlier displaced by end portion 20.1 of the guiding edge 17, back to the initial position.

The knockover sinker plate 11 has at its rear end a control leg 34 which is wider than the leg 27 of the sinker plate 10. The driving-out edge 35 of control leg 34 of the knockover plate 11 cooperates with the guiding edge 17 of the cam members 14 and 15 and also with the edge 20 of the adjustable cam member 22, and the returning edge 36 of control leg 34 cooperates with the guiding edge 18 of the cam member 16. The knockover plate 11 is also provided with a returning portion 37 which forms at its front side an inclined thread placing edge 38.

As mentioned above both sinker plates 10 and 11 lie tight with their longitudinal sides near one another in slots 39 of the plate ring 13 (FIG. 10). As can be seen from FIG. 4, the returning portion 37 of the knockover plate 11 is so high that it overlaps the parallel edges of slot 32 of the sinker plate 10 and its inclined thread placing edge 38 limits the length of the slot 32.

FIG. 4 also shows the latch-type needle 40 associated with the sinker plates 10 and 11. A needle movement path 41 is shown in FIG. 5. Thread guides 42 and 43 are provided, on which the plush threads and the main threads are supplied to the needles separately from each other, as seen from FIG. 5.

In producing of plush webs the plush mesh is usually formed by main threads and plush threads and the plush threads are connected with the mesh so that a double mesh is formed comprised of main threads and plush threads. The main thread always lies above the low back portion of the sinker plate and also before the sloped edge 31 of the plate whereas the plush thread, which forms a longer plush loop, lies above the back portion 29 of the plate, which is positioned higher than the edge 31.

When a main thread is supplied to the feeding position at guide 42, the main thread is guided into the needle 40, via the sloped edge 31 into slot 32 of plate 10, from where it is guided to the sloped edge 38 of plate 11. After the feeding of the main thread into the needle both plates 10 and 11 are displaced in the direction of the needle so that during the following feeding of the plush thread into needle 40 at the feeding position at guide 43, the thread is guided over the back portion 29 of plate 10. The main thread 50 shown in FIGS. 11–13 always runs below the back portion or projection 29 of plate 10. The guidance of the main thread, however is known in the art of circular knitting machines for producing one-face plush webs.

It is to be understood that the driving movement of the plates 10 and 11 in the direction of the machine axis, or in the direction of the middle point of the ring takes place radially and inwardly, whereas the reversing or driving-away movement, due to cooperation of guiding edge 18 with the returning portion 28 or 36 of plates 10, 11, takes place radially outwardly.

Plush sinker plate 10 and associated therewith knockover plate 11 are controlled partially together and partially independent from each other—as will be explained in detail below.

Figure 9:
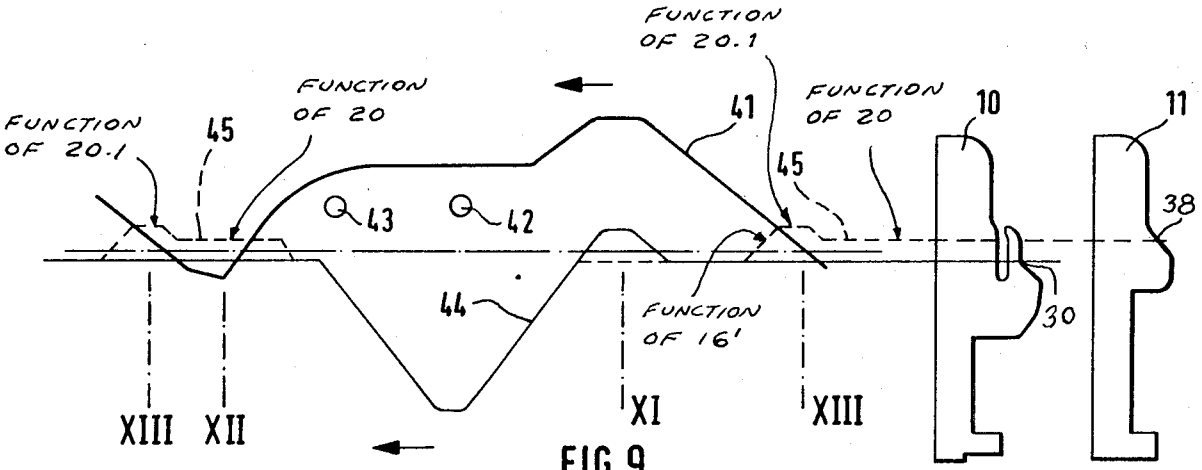
FIG. 9 is a combined view showing the control curve for the needle and the control curve for both sinker plates.

With reference to FIG. 9 it is seen that needle curve 41 is shown by the thick solid line. In addition, a thin solid line identifies a curve 44 of the plush plate 10 and a dotted thin line identifies a portion 45 of the curve of the motion of the knockover plate 11, as long the knockover sinker plate 11 is moved by the cam members of FIG. 3 independently from the plush sinker plate 10. A relative displacement between the plush sinker plate 10 and the knockover sinker plate member 11 takes place before and after the position XI and before and after the positions XII and XIII at the needle curve 41.

The rear legs or projections 27 and 34 of plates 10 and 11 extend, as shown in FIG. 3, into a control channel formed between the cam members 14, 15 and 16 of the cam ring section 12. The guidance of the plates 10 and 11 result therefore by the cam member 16, so that the path of plate 10 is influenced either on the control edge 28 or on the raising edge 33. The knockover plate 11 is guided by the cam member 16 either on the control edge 36 or on the control edge 37'. With reference to FIG. 3, cam member 16 is positioned between edges 28 and 33 of plate 10 and between edges 34 and 37' of plate 11. The plates 10 and 11 are moved through the section of the cam ring 12 in the direction shown by arrow N. The control edges 28 and 36 of plates 10 and 11 cooperate with the guide edge 18 of the cam member 16. The control edge 33 of plate 10 and the returning portion 37 of plate 11, forming the control edge cooperate with the guide edge 19 of the cam member 16 in a straight-line manner, whereas the plates pass through the section of the cam ring 12. This guidance through the cam member 16 is interrupted only in the region of adjustable cam members 22 and 24; the guidance of the plates through the control edges 20 and 23 is effected by the adjustable cams. The guiding edge 23 of the adjustable cam member 24 cooperates with the edge 33 of plate 10. The front edge 20 of the adjustable cam member 22 affects the movement of the plate 11 on its rear edge 35, which is influenced by the guiding edge 17 of the cam members 14 and 15. Thus, various adjustment movements of both plates 10 and 11 in the individual positions of the curved path of these plates are obtained in the above manner.

The edge 33 of plate 10 will be also guided in the region of edge 23 by this edge 23 of cam member 24 whereas the movement of plate 11 in this region is influenced only by the cam member 16, particularly by guiding edges 18 and 19.

The rear edge 35 of the plate 11 in the region of adjustable cam member 22 is also controlled by the front edge 20 of the adjustable cam member 22 whereas plate 10 in this region is guided only by cam member 16, which with control edges 18 and 19 cooperate with edges 33 and 28 of plate 10. It is understandable that, after the cam member 16 has extended into the space between edges 33 and 28, the guiding edge 18 of cam member 16 interacts with the edge 28 when the reversing movement of plate 10 (upwardly in relation to FIG. 3), should take place, whereas the guiding edge 19 of cam member 16 interacts with the edge 33 of plate 10 when the adjustment movement of plate 10 in the returning or driving-away direction (downwardly in FIG. 3) should take place.

FIGS. 6 through 8 illustrate sectional views of the relative positions of plates 10 and 11 controlled by the respective cam members, taken along lines VI through VIII, respectively of FIG. 3. The directions of the movement of plates 10 and 11, respectively, are shown by arrows.

Figure 11:
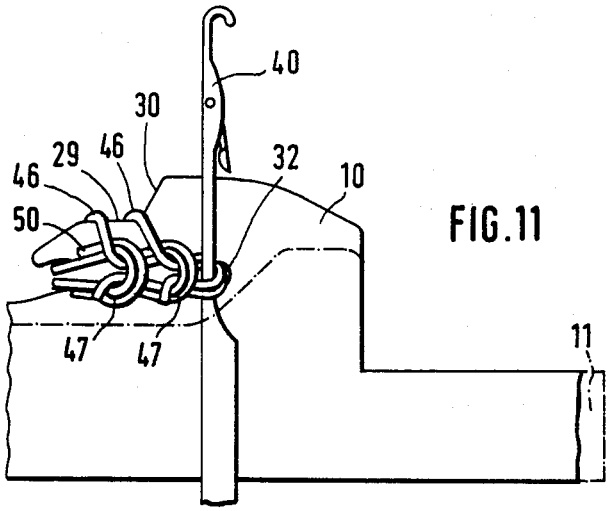
FIG. 11 is a partial lateral view of both plates with the associated needle in the position XI of the needle according to the needle curve shown in FIGS. 5 and 9.
Figure 12:
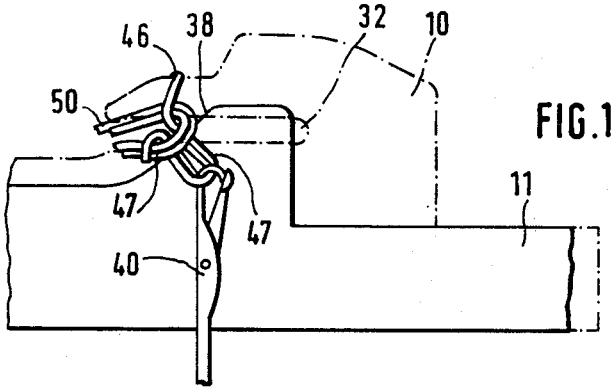
FIG. 12 is a partial lateral view of both plates and the needle in the position XII of the needle according to the curve of FIGS. 5 and 9.
Figure 13:
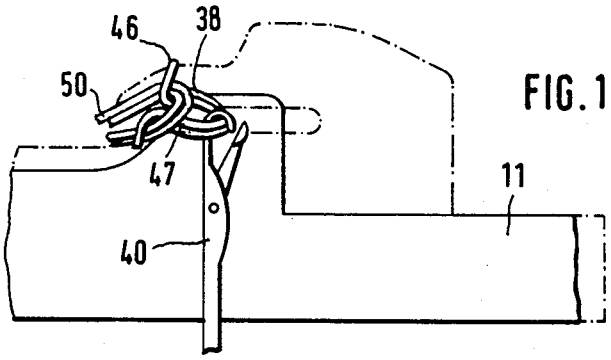
FIG. 13 is a partial lateral view of both plate members and the needle in the position XIII of the needle according to the needle curve of FIGS. 5 and 9.

FIGS. 11–13 show the relative positions of the needle 40, plush sinker plate 10, and the knockover plate 11 at the locations XI, XII and XIII of the needle according to curve 41 of FIGS. 5 and 9. Solid lines in FIGS. 11–13 identify such the plate 10 or 11, which acts in the respective curve location upon the plush web. The other plate is shown in dotted lines. These Figures show the plush threads with plush loops 46 formed over the back portion 29 of the plush sinker plate 20 and a mesh 47 formed therefrom.

In operation, the plush plate 10 is moved from the knockover plate perpendicularly to the movement of the needle in the horizontal plane in the direction towards the needle and away from the needle. The path of this movement is curved in the radial direction of the axis of rotation of the machine. As seen particularly in FIG. 11, the plush sinker plate 10 is displaced from the front edge 23 (shown in FIG. 3) of cam 24 in the direction towards the needle from the right to the left. This movement of the plush sinker plate 10 relative to the knockover plate 11, which in this region is radially immovable, results in additional tightening of the plush loop 46, formed on the back portion 29, on the step 30.

FIG. 12 shows the relative position of the sinker plates 10 and 11 in the position of the needle corresponding to position XII of the needle curve 41. In this region the needle 40 is in its deepest loop sinking position. Before this the knockover plate 11 is somewhat displaced to the needle 40. Thereby, the both threads inserted in the needle hook, namely the main thread and the plush thread, are placed in their positions. They are located now in a desirable row sequence so that at the back side of the finished knitted fabric they overlap one another. Between the position XII and the position XIII of FIG. 9, the knockover plate 11, in accordance with the curve 45 in FIG. 9 is driven out further relative to the unchangeably retained plush sinker plate 10 due to the thread placing edge 38 of the knockover plate 11 acting upon the knitted fabric edge; thereby it is guaranteed that the needle 40 which starts its raised movement is not inserted into the previously formed mesh 47 or loop 46.

The value of the returning or driving-out movement of the plush plate 10 in the position XI can be adjusted by the adjustable cam member 24 and thereby be brought into correspondence with the plush thread used. The front edge 23 of the adjustable cam member 24 acts upon the returning edge 33 of the plush plate 10. The driving movement of the knockover plate 11 for sinking the loops of the mesh in the position XII can also be adjusted with the aid of the adjustable cam member 22 and thereby brought into correspondence with the yarn used. Because of this, an orderly placing of the threads, and thereby a neat coating of the web rear side, is guaranteed. In the region of the position XII, the front edge 20 of the adjustable cam member 22 controls the knockover plate 11 by acting upon the edge 35 of the leg 34.

The cam members 14, 15 and 16 can control plates 10 and 11 in each set separately and independently from each other. These cams control the relative movement between these plates such that such relative movement results for tightening a plush loop (46) when the associated needle 40 is in a raised position and also for positioning main and plush threads when the needle is moved to a loop sinking position, and for tightening a mesh 47, produced from plush and main threads, when the needle is in the loop sinking position and is beginning to be raised, as can be seen in FIGS. 11–13.

It will be understood that each of the elements described above, or two or more together, may also find a useful application in other types of constructions differing from the types described above.

While the invention has been illustrated and described as embodied in a circular knitting machine for producing one-face plush webs of main thread and plush thread, it is not intended to be limited to the details shown, since various modifications and structural changes may be made without departing in any way from the spirit of the present invention.

Without further analysis, the foregoing will so fully reveal the gist of the present invention that others can, by applying knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circular knitting machine for producing one-face plush webs from main threads and plush threads, the machine comprising a plurality of movable needles; a plate ring including a plurality of plate members cooperating with said needles for producing a mesh from said threads; and a plurality of cam members for controlling a longitudinal movement of said needles and for controlling a movement of said plate members radially towards and away of said needles, said needles and said plate members being arranged so that each of said needles cooperates with two adjacently positioned, parallel plate members to produce and tighten plush loops to form a mesh, one of said two plate members having a slot for receiving a main thread and a stepped back portion for supporting a plush thread, whereas the other of said two plate members has a thread placing edge adapted to limit the effective length of said slot of said one plate member, said cam members being adapted to control said two plate members separately and independently from each other and being arranged so that a relative movement between said two plate members results (a) for tightening a plush loop (46) when the associated needle (40) is in a raised position,
(b) for positioning main and plush threads when the needle is moved to a loop sinking position, and
(c) for tightening a mesh (47) produced from plush and main threads when the needle is in the loop sinking position and is beginning to be raised.

2. A circular knitting machine as defined in claim 1, wherein said cam members include a first cam member arranged to cooperate with said one plate member for providing said tightening the plush loop, and a second cam member cooperating with said other plate member for providing said positioning main and plush threads, said first and second cam members being adjustable in directions of movement of said plate members.

3. A circular knitting machine as defined in claim 1, wherein said cam members include guiding cam members and returning cam members, each of said plate members having a rear end and a leg portion at said rear end, the leg portion of said other plate member which cooperates at its one side with said guiding cam members and at its other side with said returning cam members being wider than the leg portion of said one plate member which cooperates with said returning cam members.

4. A circular knitting machine as defined in claim 3, wherein said one plate member has a driving edge formed at a distance from the leg portion of the same and cooperating with the associated driving cam members.

5. A circular knitting machine as defined in claim 1, wherein said slot of said one plate member is elongated in a first direction, said thread placing edge of said other plate member being inclined to the elongation of said slot.

6. A circular knitting machine as defined in claim 1, wherein said slot of said one plate member has a small width which only corresponds to a predetermined maximum yarn thickness.

7. A circular knitting machine as defined in claim 1; and further comprising a needle cylinder provided with said plurality of said needles.

* * * * *